US006779367B2

(12) United States Patent
Mitchell et al.

(10) Patent No.: US 6,779,367 B2
(45) Date of Patent: Aug. 24, 2004

(54) BRASSIERE AND A METHOD OF MANUFACTURING TWO SEAMLESS CIRCULAR KNIT DOUBLE LAYER BRASSIERES FROM A SINGLE BLANK

(75) Inventors: John C Mitchell, Asheboro, NC (US); Robert T Spillane, Cornelius, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/444,513

(22) Filed: May 22, 2003

(65) Prior Publication Data

US 2003/0230120 A1 Dec. 18, 2003

Related U.S. Application Data

(60) Provisional application No. 60/382,874, filed on May 22, 2002.

(51) Int. Cl.[7] ..... D41B 9/16

(52) U.S. Cl. ..... 66/176; 66/196; 450/92

(58) Field of Search ..... 66/8, 171, 172 R, 66/175–177, 196, 197; 450/156, 8, 10, 30, 31, 37, 92

(56) References Cited

U.S. PATENT DOCUMENTS

| | | | | | |
|---|---|---|---|---|---|
| 4,682,479 | A | * | 7/1987 | Pernick | 66/176 |
| 5,479,791 | A | * | 1/1996 | Osborne | 66/171 |
| 5,592,836 | A | * | 1/1997 | Schuster et al. | 66/176 |
| 6,125,664 | A | | 10/2000 | Browder, Jr. | 66/176 |
| 6,192,717 | B1 | | 2/2001 | Rabinowicz | 66/177 |
| 6,287,168 | B1 | | 9/2001 | Rabinowicz | 450/75 |

* cited by examiner

*Primary Examiner*—Danny Worrell
(74) *Attorney, Agent, or Firm*—Ohlandt, Greeley, Ruggiero & Perle, L.L.P.

(57) ABSTRACT

The present invention relates to a method of manufacturing a single knit tubular blank, and the resultant blank and products. The method provides two circular knit brassieres each having first and second layers, thereby minimizing the steps in the process of manufacturing.

29 Claims, 2 Drawing Sheets

BRASSIERE AND A METHOD OF MANUFACTURING TWO SEAMLESS CIRCULAR KNIT DOUBLE LAYER BRASSIERES FROM A SINGLE BLANK

This application claims priority from U.S. Provisional Patent Application Ser. No. 60/382,874, filed on May 22, 2002.

BACKGROUND OF THE INVENTION

1. Field of the Invention

The present invention relates to a method of manufacturing two brassieres from a single blank, and the resultant brassieres. More particularly, the present invention relates to a method of manufacturing a single seamless, circularly knit bra blank that has two individually integrated knitted seamless double layer brassieres in the same blank. The present method provides for minimization of the steps in the manufacturing process by completing some manufacturing steps during formation of the blank. Moreover, the present method provides for reduced manufacturing time by simultaneously knitting two double layer brassieres in one blank.

The brassiere blank has a first portion or brassiere having both an inner and outer layer of fabric formed in a cylindrical shaped blank. The first portion is seamlessly joined to the top edge of a second portion or brassiere, also having inner and outer fabric layers formed in the same cylindrical shaped blank.

2. Description of the Prior Art

The use of generally cylindrical blanks in the manufacturing of double layer brassieres is known. For example, U.S. Pat. No. 6,125,664 to Browder, Jr., entitled BRASSIERE, BRASSIERE BLANK AND METHODS OF MAKING SAME describes the use of a cylindrical blank to form one double layer brassiere. A blank is formed followed by the knitting of a welt band in the mid section of the blank. A lower torso part is then pulled upward, over the welt band and matched against the upper torso part. One double layer brassiere is then formed by stitching and knitting.

SUMMARY OF THE INVENTION

It is an object of the invention to provide a method of manufacturing two double layer circular knit brassieres from a single blank.

It is another object of the present invention to provide a single blank, which includes four layers from which two double layer circular knit brassieres may be manufactured.

It is still another object of the present invention to provide a single blank having two fold lines to fold each of the two outer layers over a separate one of the inner layers of the brassiere.

It is yet another object of the present invention to provide a blank for forming two circular knit brassieres with each brassiere having an anchoring chest band hidden from view.

It is still yet another object of the present invention to provide a blank containing two individual two-ply brassiere garments, each having discretely placed integrally knitted support elements or features on the inner fabric layer. Specifically, in the central gore area between the breast cups, and to include the areas under and encircling the breast cups.

It is a further object of the present invention to provide a method of manufacturing a double layer circular knit brassiere having a mock terry or true sinker produced terry loop stitch construction knitted into at least the lining layer of the brassiere or between the outer and inner layer of the brassiere.

It is still a further object of the present invention to provide for the inclusion of an arcuate underwire support under the breast cups placed either on the inner fabric layer or, if desired, between the inner and outer layers.

These and other objects and advantages of the present invention will be achieved by a method according to the present invention. The method provides for forming a single blank used for making two brassieres on a circular knitting machine. The method includes forming an inner layer of material, forming anchoring chest bands at both ends of the blank on the inner layer material, forming outer layer material sections integrally knitted to and extending from each of the bands, and joining the edge of the outer material, opposite the chest anchoring bands, to the inner layer by a stitch line created by a transfer of held loops during the completion of knitting of each of two turned welts that include two double-ply bras within the blank.

A blank is also provided having two upper torso parts, with each part having an inner layer, outer layer, and a hidden chest anchoring band. The outer layer of each part has a fold line adjacent the anchoring chest band. The edge of the outer fabric layer, opposite the hidden anchoring chest band, is integrally knitted to the inner layer. The two individual upper torso two-ply parts are continuously knitted and connected to a single layer of either an inner or an outer layer material. The single blank exits the circular knitting machine fully assembled as two connected two-ply brassieres.

BRIEF DESCRIPTION OF THE DRAWINGS

The above and other objects, advantages and benefits of the present invention will be understood by reference to the detailed description provided below and the accompanying drawings.

DETAILED DESCRIPTION OF THE INVENTION

Figure 1:
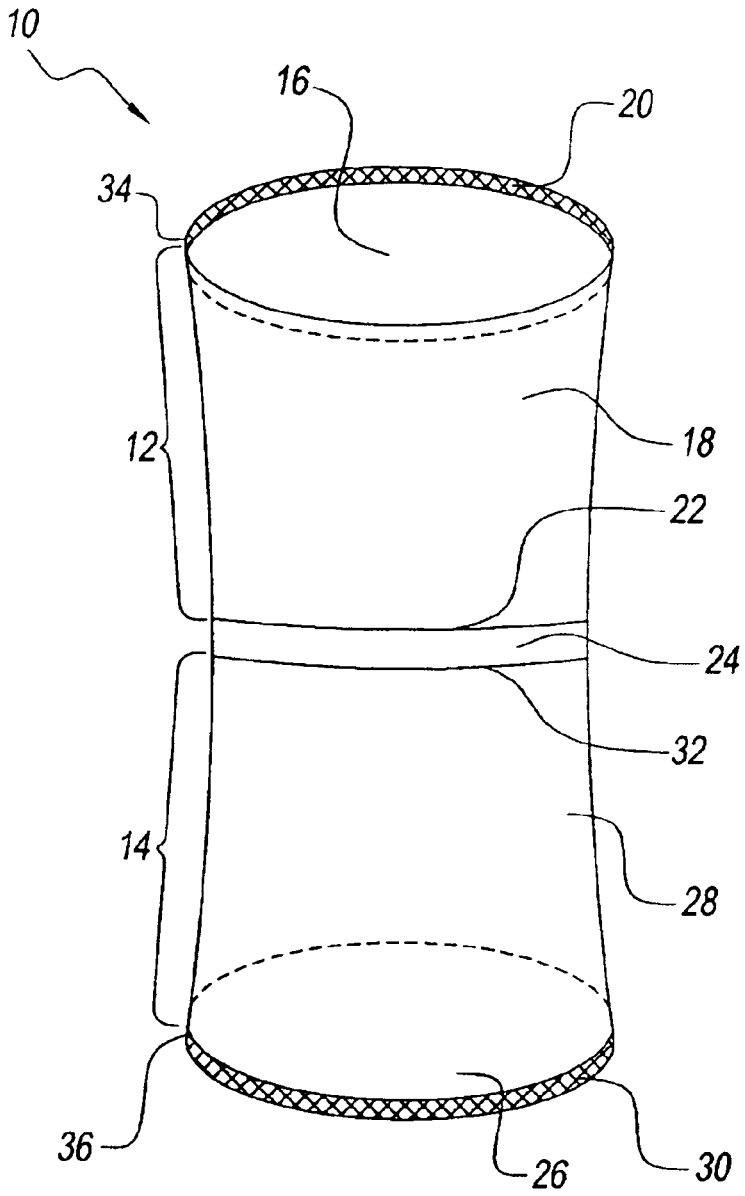
FIG. 1 is a perspective view of a blank according to one embodiment of the present invention.

Referring to the drawings, and in particular to FIG. 1, there is provided a blank according to a first embodiment of the present invention generally represented by reference numeral 10. The blank 10 is formed in a cylindrical shape.

The blank 10 is preferably formed on a circular weft knitting machine. Preferably, the circular knit machine has a computerized electronic needle and yarn feed selection system, such as circular knit machine Model No. SM8-8, or SM8-83 as manufactured by Santoni® of Brescia, Italy. The blank 10 is a generally cylindrical tube having four layers that, upon manufacture, will correspond to portions of two double layer brassieres.

The blank 10 includes an first upper torso two-ply portion 12 and a second upper torso two-ply portion 14. The upper torso two-ply portion 12 and upper torso two-ply portion 14 are seamlessly joined by an area 24 of, inner or outer, single layer material.

The two ply of the first upper torso portion 12 includes an inner ply or layer of material 16 and an outer ply or layer of material 18 separated by an anchoring chest band 20, which is preferably a single layer band. Preferably, a fold line 34 forms in the outer material layer 18, adjacent the band 20. The edge of the outer layer 18, opposite the single layer band 20 is knitted to the inner layer 16 at a stitch line 22 during the completion of forming and closing a first turned welt. The second upper torso portion 14 has an inner layer of material 26 and an outer layer of material 28 separated by a second anchoring chest band 30. Preferably, a fold line 36 is formed in the outer material layer 28, adjacent the chest anchoring band 30. The edge of the outer layer 28, opposite the band 30, is integrally knitted to the inner layer 26 at a stitch line 32 during the completion of forming a second turned welt.

The blank 10 is manufactured by the circular knitting machine and exits the knitting machine completely assembled, as shown for example in FIG. 1. No additional blank 10 assembly or manual folding operations or steps are required. The method of forming a single blank used for making two double layer brassieres on a circular knitting machine, includes forming an inner layer of material, forming anchoring chest bands at both ends of the inner layer material, forming outer layer material sections extending from each anchoring chest band, and joining the edge of the outer material, opposite the hidden anchoring chest band, to the inner layer by a stitch line created by the transfer of held loops during the completion of forming each of two individual long turned welts or brassieres interconnected during knitting. Each long turned welt includes a two-ply brassiere and is integrally knitted so as to form one single blank.

The blank 10 is ready for further manufacturing steps, such as dyeing, finishing, and/or boarding to form two double layer circular knit brassieres. The manufacturing steps may be completed with the blank 10 fully assembled, upon exiting the circular knitting machine, or the upper and lower portions 12, 14 of the blank can be separated by removing the gap 24 of inner material. Preferably, the maximum number of manufacturing steps are performed with the upper and lower portions 12, 14 of blank 10 not separated, which reduces handling and manufacturing costs for each brassiere.

The inner layers 16, 26 are material suitable for an inner layer of a brassiere, such inner layers 16, 26 are preferably formed with yarns selected for softness, comfort and wicking properties. The inner layers 16, 26 include yarns with one or any combination of stitches, such as plain, knit, miss, or tuck, to provide body comfort and support to the wearer. A miss stitch is also known as a float stitch. The inner layers 16, 26 are preferably made of either textured nylon having a relatively high number of fine denier filaments or a microfiber having about 20 to about 120 denier or spun yarn, such as cotton, in the size range of about 40/1's to about 60/1's cotton count. Such yarn provides softness, comfort and desired moisture wicking properties. Additionally, the inner fabric layers 16, 26 are formed using an elastomeric stretch yarn such as spandex in combination with said nylon or cotton non-stretch yarns.

The outer fabric layers 18, 28 may include the same or different yarn combinations and constructions as the inner fabric layers 16, 26.

The knit construction of inner layers 16, 26, which form the respective inner fabric layers of the two brassieres, may be any combination of conventional knit stitches, such as plain, knit, miss or tuck, with the potential of additional yarns or knit constructions, such as a true sinker produced terry loop, added in strategically engineered areas to provide both support or lift, as well as moisture wicking properties, thereby increasing wearer comfort. Such strategic areas are, for example, under the breast cups or in a the center gathered panel area between breast cups.

The outer layers 18, 28 include material suitable for an outer layer of a respective brassiere. The outer layers 18, 28 are preferably made of synthetic continuous multifilament flat or textured polymer or spun yarn. The outer layers 18, 28 preferably also have an elastomeric yarn, such as bare spandex or spandex, that is covered with a textured multifilament nylon yarn. The combination of yarns forms a fabric that may contain a spun yarn, such as cotton, in the range about 40/1's to about 60/1's count or synthetic continuous multifilament flat or textured yarn, such as nylon, in a range between 10 to about 200 denier, and preferably from about 60 to about 120 denier.

The outer layers 18, 28 of each brassiere are formed on a circular knitting machine using one or any combination of knit stitches. Such stitches may include, but are not limited to, plain, knit, miss or tuck stitches. The outer fabric layers 18, 28 may have a plain appearance or, optionally, may have unique aesthetic and recognizable knitted-in characteristics including, but not limited to, a Jacquard pattern design, geometric, stylized logo, abstract, or other designs or patterns such as florals.

The inner layers 16, 26 may also include patterning (not shown) that outlines the shape of each brassiere. The patterning defines parts of the brassiere to be cut and formed, such as the breast cups, neckline and/or straps.

The central gore area between the breast cups, the area under the cups, and the lower area encircling the cups, can also be knitted with discretely placed engineered shorter stretch zones in order to give added support and shaping as well as comfort to the wearer.

The anchoring chest bands preferably are welt bands, 20, 30 that may include materials that are denser than the outer material layers 16, 26. A fold line for the outer material layers 16, 26 is located adjacent the chest anchoring bands 20, 30. For example, the first upper torso part 12 includes a fold line 34 for the outer layer material 18 adjacent the first single layer anchoring chest band 20. For example, the second upper torso part 14 includes a fold line 36 for the outer layer material 28 adjacent the second single layer chest band 30. The fold lines 34, 36 result in brassieres having a straight smooth edge at the bottom of each brassiere. The fold lines 34, 36 may be formed by any method known in the art such as, by way of example, by adding stitches in the fold area or by dropping stitches in the fold area.

In another embodiment of the invention, the anchoring chest bands 20, 30 may also be formed by adding in, during the circular knitting process, additional heavier denier bare spandex elastomeric yarn, or less preferably, a nylon covered spandex yarn thereby causing a greater fabric density in the welt bands 20, 30 portions than the fabric and yarn density used to form the inner layers 16, 26 and the outer layers 18, 28. The single layer anchoring chest bands 20, 30 are included in the inner layers of essentially both long turned welt two-ply bras. In addition, the welt bands 20, 30 are hidden from view by the outer layer of the bra garment.

The manufacturing of a single blank 10 having four material layers, which may be formed into two double layer brassieres, allows for an increase in efficiency and cost savings in the manufacturing process. The manufacturing process results in a single blank 10 including a first upper torso part 12 and second upper torso part 14 that may each be further manufactured to form two double layer circular knit brassieres. The handling of one blank 10 decreases handling and manufacturing costs.

After the blank 10 is formed, the blank is removed from the circular knitting machine to be further processed through the steps of knitting, dyeing, finishing and/or boarding. Handling of one blank 10 further reduces costs, since the blank may be dyed without being separated.

The manufacturing steps to form two brassieres from the single blank 10 will be illustrated herein using the first upper torso part 12. Similar manufacturing steps will be performed, on second upper torso part 14, to form the second brassiere.

Figure 2:
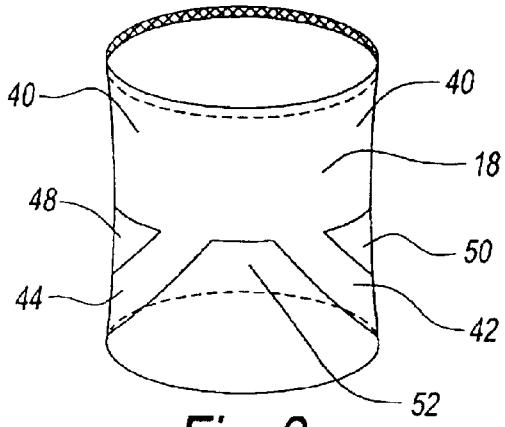
FIG. 2 is a perspective view of the front of the upper torso part of FIG. 1.
Figure 3:
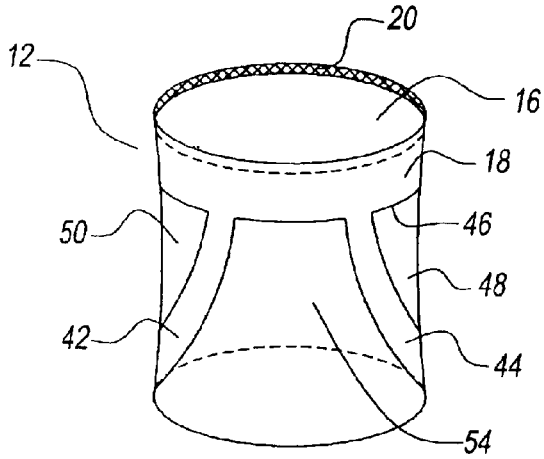
FIG. 3 is a perspective view of the back of the upper torso part of FIG. 1.
Figure 4:
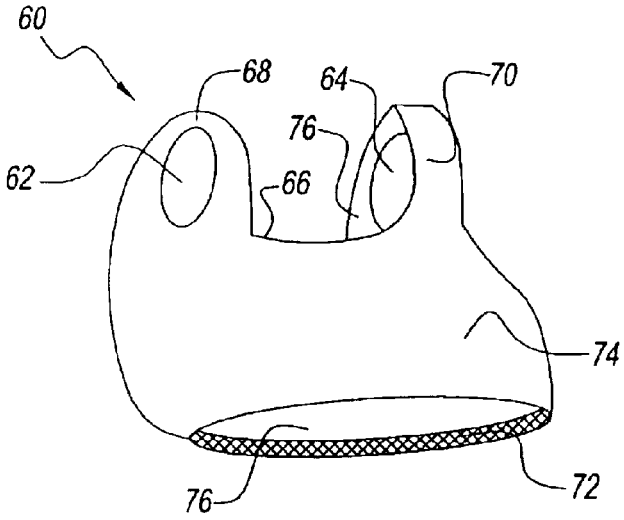
FIG. 4 is a perspective view of one embodiment of a double layer brassiere formed according to the present invention.

Referring now to FIGS. 2 to 4, a brassiere 60, shown in FIG. 4 may be formed from the upper part or brassiere 12 shown in FIGS. 2 and 3. The outer layer 18 may be joined to the inner layer 16 of the upper part 12 to form brassiere 60. The outer layer 18 may include patterning that defines the breast cups 40, straps 42, 44, and the neckline of brassiere 60. The patterning on outer layer 18 defines outer removable sections 48, 50 to define arm holes 62, 64 of brassiere 60. The patterning also defines a front removable section 52 and a rear removable section 54 that defines a neckline 66 of brassiere 60. The patterning is dependent on the style of brassiere 60. For example, the brassiere 60 could be patterned as a strapless brassiere. Also, the straps could be attached later in the manufacturing process.

The arm holes 62, 64 of brassiere 60 are formed by joining inner and outer layers 16, 18 by knitting or stitching along patterning defining arm holes 62, 64 and then removing the outer removable sections 48, 50 from upper torso part 12. The neckline 66 and straps 68, 70 of brassiere 60 can then be formed by joining inner and outer layer 16, 18 of upper torso section 12 along the pattern defining the inner edge of straps 68, 70 and neckline 66, followed by removing front section 52 and the back section 54, to form double layer brassiere 60. The brassiere 60 includes an anchoring chest band 72, which is shown in FIG. 4 as a hidden band. The band 72 is adjacent inner material 76 and is inside the brassiere 60, covered by outer layer material 74, and thus hidden from view.

Further manufacturing steps may also be taken on the torso parts 12, 14, such steps including forming lower edges along the bottom edge of the chest anchoring bands 20, 30. For example, a rigid flat or textured nylon yarn feed knitting with a knit and miss pattern technique, and simultaneously, a spandex stretch yarn using a knit and tuck stitch combination technique may be used to form a decorative scallop edge treatment for the bra bottom edge, or a mini turned welt may be formed to create yet another smooth beaded edge treatment. Other manufacturing steps include adding an underwire and/or adding a front closure or rear closure to each brassiere.

In yet a further embodiment of the present invention, the blank 10 may include a terry loop stitch construction knitted into the brassiere. The terry loop may be a true terry loop or mock terry loop. The terry loop may be knitted into the inner layer of the brassiere so that the terry loop contacts the brassiere wearer, or the terry loop may be knitted between the lining layer and outer layer. The terry loop stitch construction may be knitted into any portion of the brassiere, such as, the breast cups, the straps, and/or the entire brassiere. Two brassieres may then be manufactured from a single blank resulting in an essentially triple layer brassiere, or a double layer brassiere that includes a terry loop layer. The terry loop stitch construction includes a hydrophylic yarn of any suitable material, such as cotton, textured microdenier nylon, or a synthetic continuous multifilament textured nylon having substantial wickable moisture moving properties.

The present invention having been thus described with particular reference to the preferred forms thereof, it will be obvious that various modifications may be made therein without departing from the spirit and scope of the present invention.

What is claimed is:

1. An integral circularly knit blank comprising:

an area having a torso encircling shape;

a first torso encircling portion, having an inner layer and an outer layer, said inner layer and said outer layer being connected by a first knitted-in anchoring chest band; and a second torso encircling portion, having an inner layer and an outer layer, said inner layer and said outer layer being connected by a second knitted-in anchoring chest band, wherein said first and said second torso encircling portions are connected by a knitted-in connecting material, said connecting material being disposed opposite said knitted-in anchoring chest bands.

2. The integral circularly knit blank according to claim 1, further comprising a first fold line adjacent said first anchoring chest band and a second fold line adjacent said second anchoring chest band.

3. The integral circularly knit blank according to claim 2, wherein said first and second fold lines are formed by adding yarns to the area adjacent said first and second anchoring chest bands.

4. The integral circularly knit blank according to claim 1, wherein said connecting material is formed by transferring knit loops held during the knitting of said first and said second torso encircling portions.

5. The integral circularly knit blank according to claim 1, wherein said connecting material is a single knitted-in layer.

6. The integral circularly knit blank according to claim 1, wherein said blank is separable into two brassiere blanks by removal of said connecting material.

7. The integral circularly knit blank according to claim 1, wherein said first torso encircling portions inner layer and said second torso encircling portion inner layer are formed using one or more knit stitches selected from the group consisting of plain, knit, miss, tuck and any combinations thereof.

8. The integral circularly knit blank according to claim 1, wherein said first torso encircling portion inner layer and said second torso encircling portion inner layer are formed from a yarn selected from the group consisting of cotton, nylon, spandex, and any combinations thereof.

9. The integral circularly knit blank according to claim 1, wherein said first torso encircling portions inner layer and said second torso encircling portion inner layer are formed from a yarn having a denier of about 20 to about 120.

10. The integral circularly knit blank according to claim 1, wherein said first torso encircling portion inner layer and said second torso encircling portion inner layer have a terry loop construction.

11. The integral circularly knit blank according to claim 1, wherein said first torso encircling portion outer layer and said second torso encircling portion outer layer are formed from a yarn selected from the group consisting of polymer, elastomeric, and any combinations thereof.

12. The integral circularly knit blank according to claim 1, wherein said first torso encircling portions outer layer and said second torso encircling portion outer layer are formed from a yarn having a denier of about 10 to about 200.

13. The integral circularly knit blank according to claim 1, wherein said first torso encircling portions outer layer and said second torso encircling portion outer layer are formed using one or more knit stitches selected from the group consisting of plain, knit, miss, tuck, and any combinations thereof.

14. The integral circularly knit blank according to claim 1, wherein said first and said second inner layers have areas of support formed by shortening stitch length in said areas of support.

15. The integral circularly knit blank according to claim 1, wherein said area is a turned welt.

16. A method of forming an integral circularly knit blank having a torso encircling shape, said method comprising the steps of:

knitting a first torso encircling portion, having an inner layer and an outer layer, said inner layer and said outer layer being connected by a first knitted-in anchoring chest band;

knitting a second torso encircling portion, having an inner layer and an outer layer, said inner layer and said outer layer being connected by a second knitted-in anchoring chest band; and knitting in a connecting material, said connecting material being disposed opposite said first and said second knitted-in anchoring chest bands, wherein said connecting material is formed by transferring knit loops held during the knitting of said first and said second torso encircling portions.

17. A method of forming a pair of double layer brassieres from a single integral circularly knit blank having a torso encircling shape, said method comprising the steps of:

knitting a first torso encircling portion, having an inner layer and an outer layer, said inner layer and said outer layer being connected by a first knitted-in anchoring chest band;

knitting a second torso encircling portion, having an inner layer and an outer layer, said inner layer and said outer layer being connected by a second knitted-in anchoring chest band;

knitting in a connecting material, said connecting material being disposed opposite said first and said second knitted-in anchoring chest bands, wherein said connecting material is formed by transferring knit loops held during the knitting of said first and said second torso encircling portions;

tacking together said first torso encircling portion inner and outer layers; and tacking together said second torso encircling portion inner and outer layers.

18. The method of forming a pair of double layer brassieres of claim 17, further comprising the steps of:

cutting and removing areas of said first torso encircling portion to form two right and two left strap portions that define a neck line and arm holes, and areas of said second torso encircling portion to form two right and two left strap portions that define a neck line and arm holes, joining said two right strap portions of said first and second torso encircling portions at their distal ends and joining said two left strap portions of said first and second torso encircling portions at their distal ends;

separating said first torso encircling portion from said second torso encircling portion by cutting along said knitted-in connecting material.

19. A pair of double layer brassieres formed from a single integral circularly knit blank comprising:

a first torso encircling portion, having an inner layer and an outer layer, said inner layer and said outer layer joined by a first knitted-in anchoring chest band; and a second torso encircling portion, having an inner layer and an outer layer, said inner layer and said outer layer being joined by a second knitted-in anchoring chest band, wherein said first and said second torso encircling portions are joined by a knitted-in connecting material, said connecting material being disposed opposite said knitted-in anchoring chest bands, wherein said pair of brassieres are separable from said blank by cutting along said connecting material, wherein said first torso encircling portion forms a first brassiere of said pair of brassieres, and wherein said second torso encircling portion forms a second brassiere of said pair of brassieres.

20. The brassieres according to claim 19, wherein at least one brassiere of said pair of brassieres has a terry loop stitch construction on at least one of said inner and outer layers.

21. The brassieres according to claim 19, wherein at least one of said pair of brassieres has at least one area of support therein.

22. The brassieres according to claim 19, wherein said at least one area of support has shortened stitches.

23. The brassieres according to claim 19, wherein each of said brassieres has a fold line adjacent said anchoring chest band.

24. The brassieres according to claim 23, wherein said fold lines are formed by adding yarns to the area adjacent said anchoring chest bands.

25. The brassieres according to claim 19, wherein said connecting material is a single knitted-in layer.

26. The brassieres according to claim 19, wherein said first torso encircling portion inner layer and said second torso encircling portion inner layer are formed using one or more knit stitches selected from the group consisting of plain, knit, miss, tuck and any combinations thereof.

27. The brassieres according to claim 19, wherein said first torso encircling portions inner layer and said second torso encircling portion inner layer are formed from a yarn selected from the group consisting of cotton, nylon, spandex, and any combinations thereof.

28. The brassieres according to claim 19, wherein said first torso encircling portions outer layer and said second torso encircling portion outer layer are formed from a yarn selected from the group consisting of polymer, elastomeric, and any combinations thereof.

29. The brassieres according to claim 19, wherein said first torso encircling portion outer layer and said second torso encircling portion outer layer are formed using one or more knit stitches selected from the group consisting of plain, knit, miss, tuck, and any combinations thereof.

* * * * *